United States Patent [19]

Platt

[11] 4,183,536

[45] Jan. 15, 1980

[54] ILLUMINATED HOCKEY PUCK

[76] Inventor: Nicolas W. Platt, Loantaka Way, Madison, N.J. 07940

[21] Appl. No.: 845,490

[22] Filed: Oct. 26, 1977

[51] Int. Cl.[2] ..... A63B 71/00

[52] U.S. Cl. ..... 273/128 R; 273/DIG. 8

[58] Field of Search ..... 273/126 R, 128 R, 128 CS, 273/128 A, 58 G, 213, DIG. 24; 362/34

[56] References Cited

U.S. PATENT DOCUMENTS

| | | | |
|---|---|---|---|
| 2,606,030 | 8/1952 | Tjomsland | 273/128 R |
| 3,102,727 | 9/1963 | Rice | 273/128 |
| 3,117,788 | 2/1964 | Buonanno et al. | 273/128 R |
| 3,539,794 | 11/1970 | Rauhut et al. | 273/DIG. 24 |
| 3,997,164 | 12/1976 | White, Sr. | 273/128 R |
| 4,015,111 | 3/1977 | Spector | 363/34 |
| 4,078,801 | 3/1978 | White, Sr. | 273/128 R |

*Primary Examiner*—Richard C. Pinkham
*Assistant Examiner*—T. Brown
*Attorney, Agent, or Firm*—Carella, Bain, Gilfillan & Rhodes

[57] ABSTRACT

Hockey puck structure is disclosed to include a generally cylindrical impact member of translucent material and a plug means disposed within the impact member containing a light source.

6 Claims, 10 Drawing Figures

ILLUMINATED HOCKEY PUCK

BACKGROUND OF THE INVENTION

One of the fastest growing sports in the United States is ice hockey. Long the national pastime of our neighbors to the North in Canada, ice hockey has become a major sport in the United States and has developed to the point of having active midget hockey leagues and competition for children and young adults of all ages from high school and college to the national and professional teams.

One of the limitations in the growth of ice hockey as a sport has been the lack of availability of ice rinks. Although the number of ice rinks has grown astronomically in recent years, there is nothing unusual to have a team hockey practice be scheduled between 3:00 a.m. and 4:00 a.m. on a typical weekday. It does not take much imagination to recognize what a schedule such as this does to a child of elementary school age. It takes even less imagination to recognize what it does to the child's parent who must transport the child to the rink, wait during the practice and thereafter transport the child home for the rest of the night's sleep.

There are a relatively large number of ponds and outdoor rinks available for use particularly in the colder northern areas. Most of these ponds and outdoor rinks, however, are not provided with lighting and as such their availability is of little value after dark. As is well recognized the farther north you go the earlier it does become dark and thus the utilization of otherwise good ice skating surfaces is lost.

How many players have been injured by a hockey puck which they did not see coming but would have seen had the illumination been better?. How many outside hockey games have gone incomplete because of the advent of dusk and the deterioration of the available light?. When observing the traditional black rubber or rubberlike hockey puck structure, how often has it been asked what can be done to improve the visibility of this structure?.

SUMMARY OF THE INVENTION

It is an object of the present invention, therefore, to provide a hockey puck which is capable of being seen in poor light conditions and which will speed up and improve the quality of play.

Another object of the present invention is to provide a hockey puck structure having self-contained illumination means.

Yet another object of the present invention is to provide a self-illuminating hockey puck structure which is simple to manufacture and inexpensive to manufacture as well as to use.

Yet a further object of the present invention is to provide a hockey puck structure which will be of sufficiently simple structure to permit commercial marketing at a relatively low price thus making the product available to the general public at a reasonable price.

A still further object of the present invention is to provide a self-illuminating hockey puck wherein the illumination means is replaceable within a reusable impact element thus reducing the cost of operation.

These objects and others not enumerated are achieved by the hockey puck according to the invention one embodiment of which may include a generally cylindrical impact member having a bore extending axially therethrough, plug means resiliently received within the bore and illuminating means disposed within the plug means.

BRIEF DESCRIPTION OF THE DRAWINGS

A more complete understanding of the present invention may be had from the following detailed description thereof, particularly when read in the light of the accompanying drawings, wherein.

DETAILED DESCRIPTION

This invention relates to hockey pucks. In particular this invention relates to hockey puck structure having internally disposed illumination to permit use of the puck in unfavorable lighting conditions.

Figure 1:
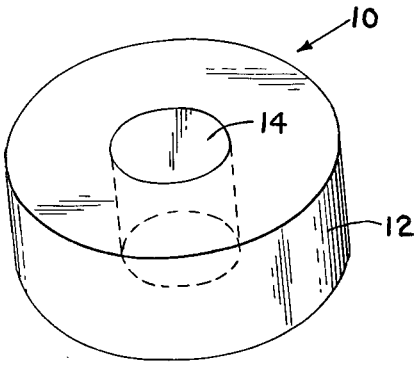
FIG. 1 is a perspective view of a hockey puck according to the present invention.

Referring therefore to the drawings, a hockey puck structure according to the present invention is shown in FIG. 1 and designated generally by the reference numeral 10.

Hockey puck 10 comprises a generally cylindrical impact member 12 and a plug means 14 which is releasably secured within impact member 12 as is discussed below in detail. Plug means 14 is structured to define a cavity within which are received chemiluminescent materials. As originally packaged the chemiluminescent materials are separated by a frangible barrier. When it is desired to actuate the luminescience, the puck is thrown against a hard surface such as the ice thereby causing rupture of the frangible barrier, mixture of the chemiluminescent materials and the resultant generation of light.

It should be noted at the outset that the materials which are desirable for use for the impact member and plug member of the hockey puck of the invention may be any translucent material having acceptable densities and coefficients of resilience as to meet published puck specifications which are generally known. Included in such materials are polyurethanes such as CYANAPRENE marketed by American Cyanamid and a comparable material marketed by the DuPont company with the tradename POLYETHER.

Generally accepted dimensions for hockey pucks are three inches in diameter, one inch in depth and between five and one half and six ounces in weight. For purposes of the present invention the plug diameter found to be most favorable is one and three eighths inches.

It should also be noted that for purposes of the present application the term chemiluminescent material means chemical photoluminescent materials which are available in the market place. Among the chemiluminescent materials suitable for use as light generating materials are those materials marketed by American Cyanamid Company, e.g. the materials used in the lightstick product known and marketed in the trade as Cyalume Lightsticks.

Figure 2:
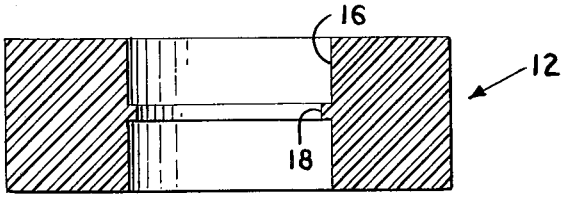
FIG. 2 is a cross-sectional view of the impact member of the puck shown in FIG. 1.

Considering now the unique details of the hockey puck according to the invention, the impact member 12 is shown in cross-sectional elevational view in FIG. 2. Referring therefore to FIG. 2 impact member 12 can be seen to comprise a generally cylindrical structure having a bore 16 extending therethrough. The axis of bore 16 is coaxial with the axis of the cylinder of member 12. Formed on the surface of bore 16 and disposed substantially centrally thereof is an inwardly extending shoulder 18. Although shoulder 18 may be dimensioned suitably to cooperate with a channel formed in the plug member 14 as is discussed below, it has been found that a shoulder thickness of one sixteenth of an inch is perfectly adequate to construct a hockey puck according to the invention.

Figure 3:
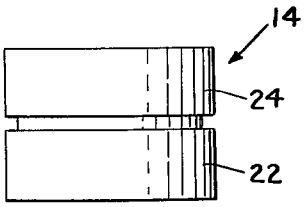
FIG. 3 is an elevational view of a plug member which may be used with the impact member of the puck shown in FIG. 1.
Figure 4:
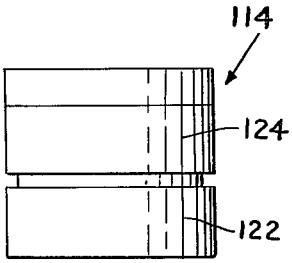
FIG. 4 is an elevational view of a second embodiment of plug member which may be used with the impact member of the puck shown in FIG. 1.

The plug member used in conjunction with impact member 12 may be a plug member such as member 14 of FIG. 3 or a plug member such as member 114 of FIG. 4.

Considering initially plug member 14 and with particular reference to FIGS. 3, 5, 6 and 7, plug member 14 can be seen to comprise a body element 22 and a cap element 24.

Body element comprises a generally cylindrical member having first and second axially extending bores 26 and 27 formed therein. The axes of bores 26 and 27 are parallel to each other and to the longitudinal axis of element 22. Further, the axes of bores 26 and 27 are displaced from each other by an avent slightly less than the sum of their respective radii such that their arcs overlap thereby creating an opening 28 therebetween. Opening 28 thus places bores 26 and 27 in fluid communication with each other.

The external surface of body member 22 is relieved adjacent its upper end to define an annular channel 30. As is discussed below in detail, annular channel 30 cooperates with the lower surface of cap element 24 to define an annular channel for receiving shoulder 18 to lock plug member 14 in playing position within impact member 12.

Formed on the upper edge of annular channel 30 is a radially outwardly extending shoulder 32. As is discussed below, shoulder 32 is sized to be received within an annular channel formed in cap element 24 such as to rigidly secure the cap element to body element 22.

Figure 5:
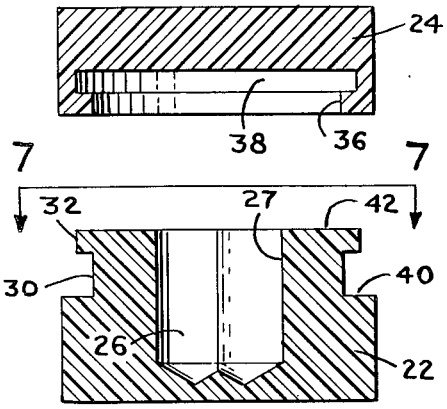
FIG. 5 is a front elevational cross-sectional view of the plug member of FIG. 3 wherein the plug components are separated.

Referring to cap element 24, the element can best be seen in FIG. 5 to comprise a generally cylindrical member having a bore 36 formed therein. The axis of bore 36 is coaxial with the axis of element 24 and its diameter is substantially equal to the diameter of annular channel 30 of body element 22.

Formed at the upper edge of bore 36 is an annular channel 38. The diameter of annular channel 38 is substantially equal to the diameter of shoulder 32 of body element 22.

The cap element and body element of plug member 14 are assembled by forcing cap element 24 axially downwardly over shoulder 32 of body element 22 until shoulder 32 is received within annular channel 38. With the cap element and body element so assembled there is defined an annular channel 40 which cooperates with shoulder 18 of impact member 12 to lock plug member 14 within the bore 16 of impact member 12.

It will be recognized that the thickness of shoulder 32 vis a vis the width of channel 38 must be such as to permit assembly of the respective elements. Determination of these dimensions however may be made empirically and is well within the capability of those skilled in these arts.

As will become clear below, it is desirable that the assembly of cap element 24 and body element 22 be such as to define a fluid tight chamber comprising bores 26 and 27 in cooperation with the inner surface of cap 24. To this end, during assembly, a suitable sealing material is deposited on the upper surface 42 of shoulder 32 such that upon assembly the desired fluid tight relationship is established.

Figure 6:
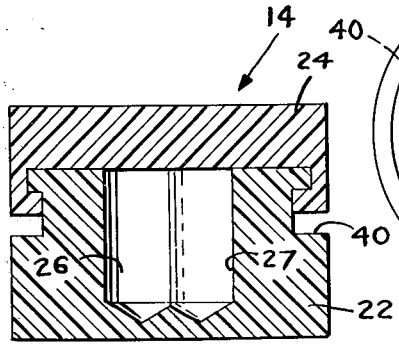
FIG. 6 is a front elevational cross-sectional view of the plug member of FIG. 3 wherein the plug components are assembled.
Figure 7:
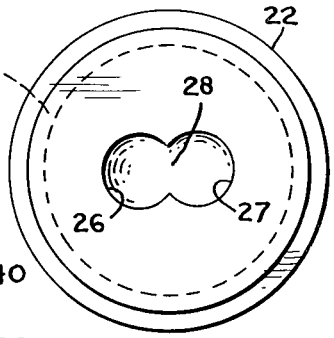
FIG. 7 is a plan view of the body portion of the plug of FIGS. 5 and 6 as seen through the plane 7—7 of FIG. 5.

The chemiluminescent materials described above generate light in in response to the reaction of two or more chemicals upon the occurrence of their mixture. Thus, with respect to plug member 14, it is contemplated that the active materials may be charged in either of two ways. First each material may be pre-packaged in a frangible capsule such as a thin glass capsule. Thereafter one capsule may be deposited in bore 26 and one may be deposited in bore 27 (FIGS. 6 and 7). In this regard bores 26 and 27 will be sized based upon the sizes of the capsules to be received or upon the relative size of the charges of active materials as is discussed below. With the capsules so inserted, cap element 24 is positioned on body element 22 with the sealing material positioned on surface 42 and the plug, upon curing of the sealing material is ready for insertion within bore 16 of impact member 12. With respect to the second mode of charging plug 14, it is contemplated that only one of the active materials be prepackaged within a frangible capsule. In this approach, a measured amount of the second active material is deposited within communicating bores 26 and 27. Thereafter the frangible capsule containing the first active material is inserted in bore 26 which is sized to receive it. In this regard the combined volumes of bore 26 and 27 should be such as to substantially equal the volume of second active chemical when added to the volume of the frangible capsule containing the first active chemical. With the first and second active materials so inserted, cap 24 is positioned on and secured to body element 22 in the manner discussed above.

With plug element 14 assembled, having been charged in either manner discussed above, the plug element may then be inserted within bore 16 of impact member 12 to form hockey puck 10.

When it is desired to activate the luminescence of the chemiluminescent materials, Puck 10 may be subjected to a shock such as by being thrown against the ice. The shock will rupture the frangible capsule or capsules the active chemicals will mix and their reaction will generate light in the desired manner.

Figure 8:
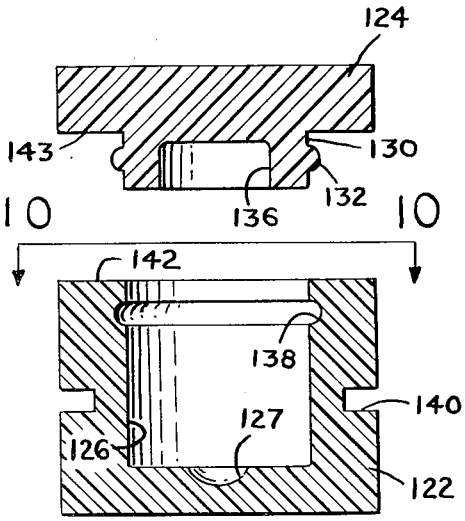
FIG. 8 is a front elevational cross-sectional view of the plug member of FIG. 4 wherein the plug components are separated.
Figure 9:
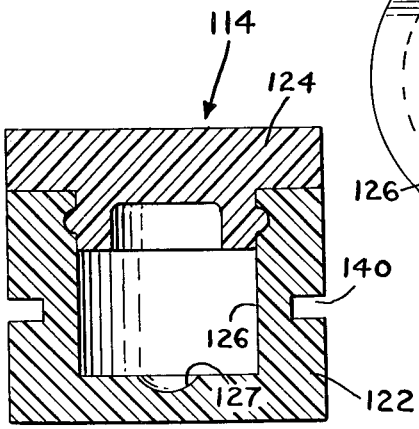
FIG. 9 is a front elevational cross sectional view of the plug member of FIG. 4 wherein the plug components are assembled.
Figure 10:
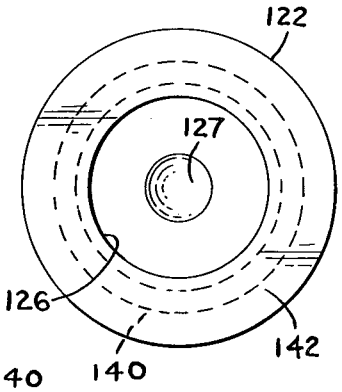
FIG. 10 is a plan view of the body portion of the plug of FIGS. 8 and 9 as seen through the plane 10—10 of FIG. 8.

Referring now to FIGS. 8, 9, and 10, there is shown an alternative structure for the plug element, which alternative structure is designated generally by the reference numeral 114. Plug member 114 can be seen to comprise a body element 122 and a cap element 124.

Body element 122 comprises a generally cylindrical member having a bore 126 formed therein. Bore 126 is coaxial with the longitudinal axis of body element 122. Formed in the base of bore 126 is a counter bore 127 which is coaxial therewith and extends only partially into the bottom wall of body element 122. Formed in the surface of bore 126 and displaced from the upper surface 142 of body element 122 is an annular channel 138. As is discussed below in detail, channel 138 is adapted to receive therein a shoulder formed on cap element 124 to secure cap element 124 to body element 122.

Formed in the outer surface of body element 122 is an annular channel 140. Annular channel 140 is dimensioned and positioned to cooperate with shoulder 18 of impact member 12 to rigidly secure plug member 114 within bore 16 of impact member 12.

As best may be seen in FIG. 8, a cap member 124 comprises a generally cylindrical member having a bore 136 formed therein. The outer surface of cap member 124 is relieved to define an annular channel 130. Formed on the surface of annular channel 130 is an annular shoulder 132. Shoulder 132 is positioned on the surface of channel 130 such that when cap element 124 and body element 122 are assembled, shoulder 132 is received within channel 138 and surface 142 of body element 122 is in surface-to-surface engagement with the radial surface 143 of cap element 124, surface 143 being defined by the radially extending wall of channel 130.

Bore 136 is dimensioned to slidably receive therein frangible capsule containing one of the active chemiluminescent materials as discussed above. Thus, in assembling plug element 114, a capsule containing one active chemiluminescent material is positioned within bore 136 of cap element 124. The cavity defined by bores 126 and 127 in body element 122 is filled with a predetermined amount of a second active chemiluminescent material. In this regard the volumes within body element 122 defined by bores 126 and 127 are determined by establishing the volumetric relationship of the first and second active chemiluminescent materials and adding thereto the physical volume of the material of the frangible capsule.

With the predetermined amount of second active material deposited within the cavity of body element 122, a sealant is coated on surface 142 and cap element 124 with the flangible capsule inserted within body element 122 as best may be seen in FIG. 9. With the cap element so positioned, the lower end of the capsule is received within bore 127, shoulder 132 is received within channel 138, surfaces 142 and 143 are in sealed surface-to-surface engagement and the frangible capsule is held firmly between bores 136 and 127. Further the entire cavity defined by bores 126, 127 and 136 is filled by the capsule and the second chemiluminescent material.

With plug element 114 so assembled, it may then be inserted within bore 16 of impact member 12 to form hockey puck 10. Further it should be noted that a non-illuminating plug may be inserted within bore 16 to permit use of puck 10 during those times when additional lumination is not necessary.

The materials for manufacturing puck 10 are generally available as is discussed above. Further the respective components may be manufactured using known techniques such as injection molding, glass encapsulating and the like.

As is evident from the foregoing, a hockey puck according to the present invention comprises a low cost efficient structure which will extend the availability of the sport far beyond its present limits. It will also be recognized by those having ordinary skill in these arts that many modifications and variations may be made to the present invention without departing from the spirit and scope thereof.

What is claimed is:

1. A hockey puck comprising a generally cylindrical impact member having an axially extending bore therethrough, said bore including a generally centrally disposed circular shoulder;

plug means releasably secured in said axially extending bore of said impact member, said plug means having an axially extending bore coaxial with said axially extending bore of said impact member, said plug means further including a relieved annular channel in its peripheral surface, said circular shoulder of said impact means and said annular channel of said plug means cooperating to define a releasable locking means for securing said plug within said impact member;

illumination means disposed within said plug means, said illumination means comprising a chemiluminescent light source including at least a first and a second chemiluminescent material which, when mixed, emit light incident to their interaction; and a frangible barrier disposed in said axially extending bore of said plug means for separating at least of one said chemiluminescent materials from the other chemiluminescent material prior to mixing.

2. Apparatus according to claim 1 wherein said plug member comprises a body element and a cap element and wherein said body element and said cap element cooperate to define said annular channel.

3. Apparatus according to claim 1 wherein said plug member comprises a body element and a cap element and wherein said annular channel is formed in the outer cylindrical surface of said body element.

4. Apparatus according to claim 3 wherein said body element includes at least a pair of bores formed therein, said bores being in fluid communication and being for receiving said at least two chemiluminescent materials.

5. Apparatus according to claim 4 wherein said bores are parallel.

6. Apparatus according to claim 4 wherein at least one of said chemiluminescent materials is contained within a frangible container, said container being breakable in response to a shock to permit mixing of said chemiluminescent materials and a reaction to generate light.

* * * * *